United States Patent [19]

Wheatley et al.

[11] 4,353,218

[45] Oct. 12, 1982

[54] HEAT PUMP/REFRIGERATOR USING LIQUID WORKING FLUID

[75] Inventors: John C. Wheatley; Douglas N. Paulson, both of Del Mar; Paul C. Allen, Solana Beach, all of Calif.; William R. Knight, Corvallis, Oreg.; Paul A. Warkentin, San Diego, Calif.

[73] Assignee: The United States of America as represented by the United States Department of Energy, Washington, D.C.

[21] Appl. No.: 154,173

[22] Filed: May 28, 1980

[51] Int. Cl.[3] ..... F25B 9/00

[52] U.S. Cl. ..... 62/6; 62/118; 62/324.6; 62/467 R

[58] Field of Search ..... 62/6, 118, 467, 324.6

[56] References Cited

U.S. PATENT DOCUMENTS

| | | | |
|---|---|---|---|
| 3,816,029 | 6/1974 | Bowen et al. | 17/223 |
| 4,044,567 | 8/1977 | Dix et al. | 62/6 |
| 4,107,935 | 8/1978 | Steyert, Jr. | 62/467 |

OTHER PUBLICATIONS

Allen; P. C. et al. "Principles of Liquids Working in Heat Engines," Proc. Nat. Acad. Sci. vol. 77, p. 39, 1/80.

*Primary Examiner*—Ronald C. Capossela
*Attorney, Agent, or Firm*—L. E. Carnahan; Roger S. Gaither; Richard G. Besha

[57] ABSTRACT

A heat transfer device is described that can be operated as a heat pump or refrigerator, which utilizes a working fluid that is continuously in a liquid state and which has a high temperature-coefficient of expansion near room temperature, to provide a compact and high efficiency heat transfer device for relatively small temperature differences as are encountered in heating or cooling rooms or the like. The heat transfer device includes a pair of heat exchangers that may be coupled respectively to the outdoor and indoor environments, a regenerator connecting the two heat exchangers, a displacer that can move the liquid working fluid through the heat exchangers via the regenerator, and a means for alternately increasing and decreasing the pressure of the working fluid. The liquid working fluid enables efficient heat transfer in a compact unit, and leads to an explosion-proof smooth and quiet machine characteristic of hydraulics. The device enables efficient heat transfer as the indoor-outdoor temperature difference approaches zero, and enables simple conversion from heat pumping to refrigeration as by merely reversing the direction of a motor that powers the device.

22 Claims, 13 Drawing Figures

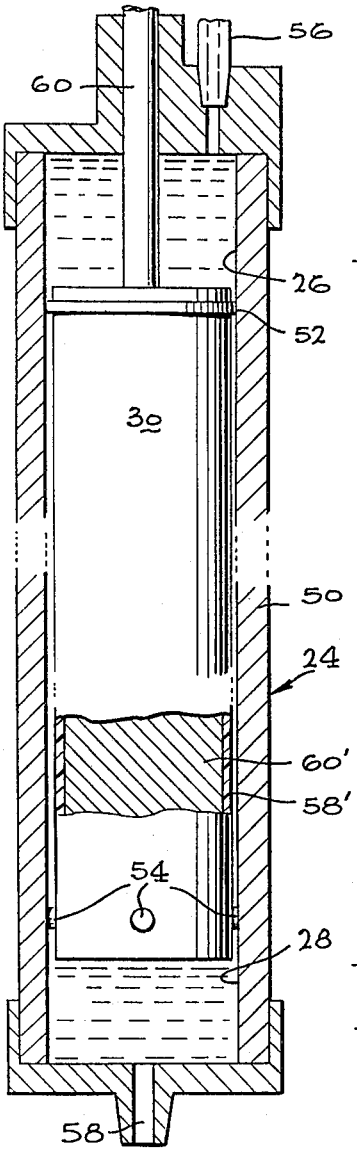
FIG. 6
FIG. 9
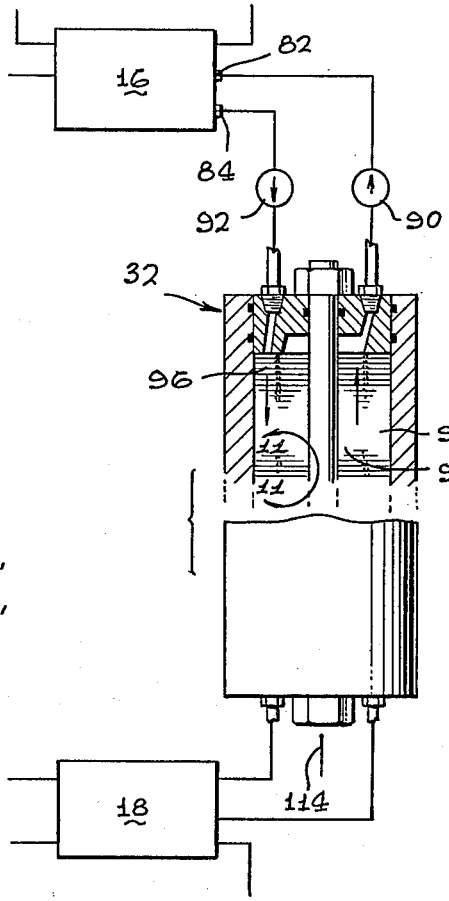
FIG. 11
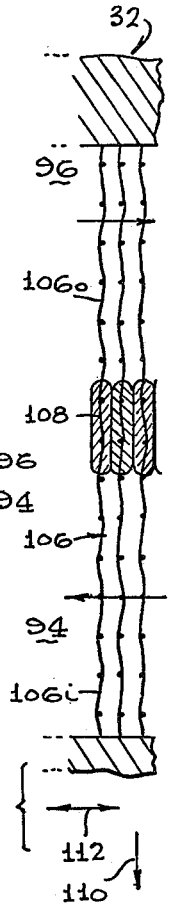
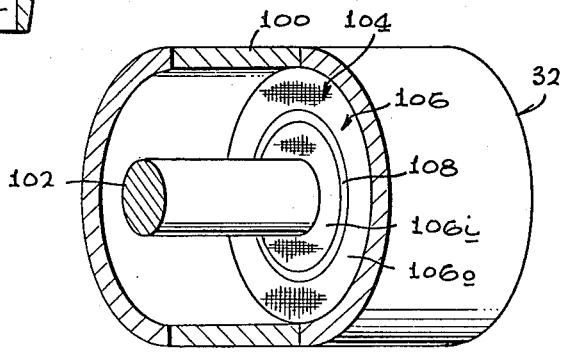
FIG. 10

HEAT PUMP/REFRIGERATOR USING LIQUID WORKING FLUID

BACKGROUND OF THE INVENTION

The U.S. Government has rights in this invention pursuant to Contract No. DE-18-03-76-ER-79, P. A. 143-13 between the Department of Energy and the University of California.

Thermodynamic energy conversion systems, or heat transfer devices, including heat pumps and refrigerators operating near room temperature, have commonly utilized both gaseous working fluids and two-phase liquid-vapor systems. In one type of heat engine operated as a heat pump, a gas is compressed to raise its temperature, and the hot gas is passed through a heat exchanger to allow heat to flow out of the gas into a heat sink (such as indoor air when heating a house on a cold day). Then the device expands the gas to lower its temperature below that of the heat source (such as relatively cool outside air), passes the expanded gas through a heat exchanger to allow heat to flow into the gas from the heat source, and returns the gas to a chamber where it is compressed again. A more compact and efficient heat pump system is provided by changing the phase of the working fluid between its liquid and gas phases. However, since the working fluid is in a gas phase for much of the time, a considerable volume of working fluid must be compressed and considerable heat must be transferred from a gaseous working fluid, so that inefficiencies occur.

Liquid working fluids were proposed and rejected for use in prime movers by Carnot. A liquid working fluid prime mover based on a novel principle was developed by J. F. J. Malone wherein liquids were caused to operate thermodynamically between relatively high temperatures (e.g., 625° F.) and nearly room temperature. The liquids utilized by Malone had very low temperature coefficients of expansion at room temperature, but much higher coefficients at higher temperatures where they might be heated by an oil or coal-fired boiler. The liquids could operate with moderately good thermodynamic efficiency in prime movers, and they had many desirable qualities including the ability to produce good heat transfer, avoid explosive hazard and operate with smooth hydraulic action. For example, Malone used water which was heated to about 625° F., where it has a considerable coefficient of expansion and is very active thermodynamically. However, near room temperature, water has a low temperature coefficient of expansion, so that very little temperature change is created for even rather large pressure change. Accordingly, Malone's system could not be used effectively as a heat pump or refrigerator wherein the working fluid is never very far from room temperature.

One object of the invention is to provide a heat transfer device (heat pump and/or refrigerator) which is of high efficiency.

Another object is to provide a heat transfer device which is easily reversed, between operation to heat a medium and operation to cool the medium.

Still another object is to provide a compact and efficient heat exchanger.

SUMMARY OF THE INVENTION

In accordance with one embodiment of the present invention, a heat transfer device (heat pump and/or refrigerator), is provided which is compact and which is efficient particularly in the thermodynamic transfer of heat between a source and sink whose temperatures differ only moderately. The apparatus includes a pair of heat exchangers respectively coupled to a heat source and heat sink, a displacer forming a pair of reservoirs coupled to the different heat exchangers, a regenerator connecting the heat exchangers, and means for compressing a working fluid that can pass between the reservoirs by way of the regenerator and a heat exchanger. The working fluid is a liquid having a temperature coefficient of expansion which is preferably above $1\times10^{-3}$ per °K. at room temperature (about 70° F. or 21° C. or 294° K.) and at a pressure greater than the critical pressure (at which the substance becomes liquid). A liquid such as propylene can be utilized, which can be compressed by a relatively easily-applied mechanical pressure change of about 2500 psi to raise its temperature appreciably, as by about 9° C. or 16° F. at room temperature, to operate effectively in either a heat pump or a refrigerator. The use of a liquid working fluid with a substantial temperature coefficient of expansion, whose pressure can be changed considerably without fear of explosion, and whose temperature can be changed considerably by moderate adiabatic pressure changes, allows advantage to be taken of the high specific heat and high heat transference of liquids as by permitting the use of small heat exchangers, and advantage to be taken of compact moderately high pressure compressors, to provide a compact unit and one which operates with high thermal efficiency.

The compression of the liquid working fluid can be accomplished by the use of a reciprocating piston which cycles relatively slowly, such as at one cycle per second, to provide time for the exchange of heat with the flowing liquid. The work done by the piston during expansion of the working fluid can be recaptured by utilizing several heat transfer units which each have a compressing-expanding piston, and with the pistons driven out of phase with one another by a common crank member. As a result, force applied by the piston to the crank member during expansion of the corresponding working fluid, helps to turn the crank member and drive one or more other pistons which are compressing their corresponding working fluids.

The novel features of the invention are set forth with particularly in the appended claims. The invention will be best understood from the following description when read in conjunction with the accompanying drawings.

BRIEF DESCRIPTION OF THE DRAWINGS

FIG. 6 is a partially sectional view of the displacer of the system of FIG. 1.

FIG. 9 is a partial sectional view of the regenerator of the system of FIG. 1.

FIG. 10 is a partial sectional and perspective view of the regenerator of FIG. 9.

FIG. 11 is an enlarged view of the area 11—11 of FIG. 9.

DESCRIPTION OF THE PREFERRED EMBODIMENTS

Figure 1:
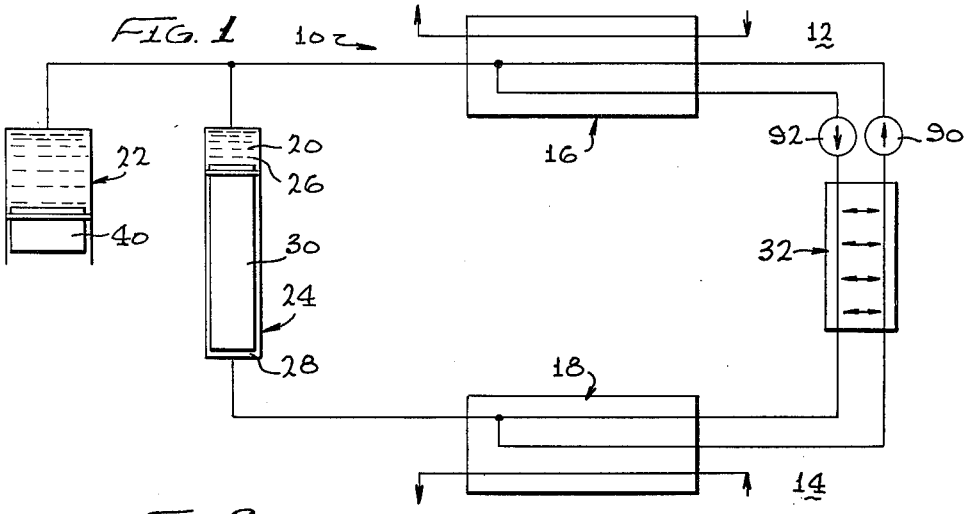
FIG. 1 is a schematic diagram of a heat pump system constructed in accordance with the present invention.

FIG. 1 shows a heat transfer device or system 10 which can be utilized to transfer heat thermodynamically between two environments 12 and 14 which are at different temperatures, such as between an indoor environment which is to be maintained at room temperature and an outdoor environment which may be colder or warmer than the indoor environment. The system includes a pair of heat exchangers 16, 18, a quantity of a working fluid 20 lying in the system, and a compressing and expanding apparatus 22 which is coupled to the working fluid to alternately compress and expand it. The system also includes a displacer 24 forming a pair of reservoirs 26, 28 that hold quantities of the working fluid. The displacer also includes a displacer piston 30 which can be operated to move fluid out of one of the reservoirs into the other, to cause the fluid to flow through the heat exchangers 16, 18, by way of a regenerator 32. The regenerator 32 is utilized to transfer heat from fluid leaving one heat exchanger into fluid leaving the other heat exchanger, so as to maximize the efficiency of the system. Fluid flow in a given channel of the regenerator is pulsating and unidirectional owing to the action of a pair of check valves 90, 92. Fluid flow in adjacent channels of the regenerator 32, is in opposite directions.

Figure 2:
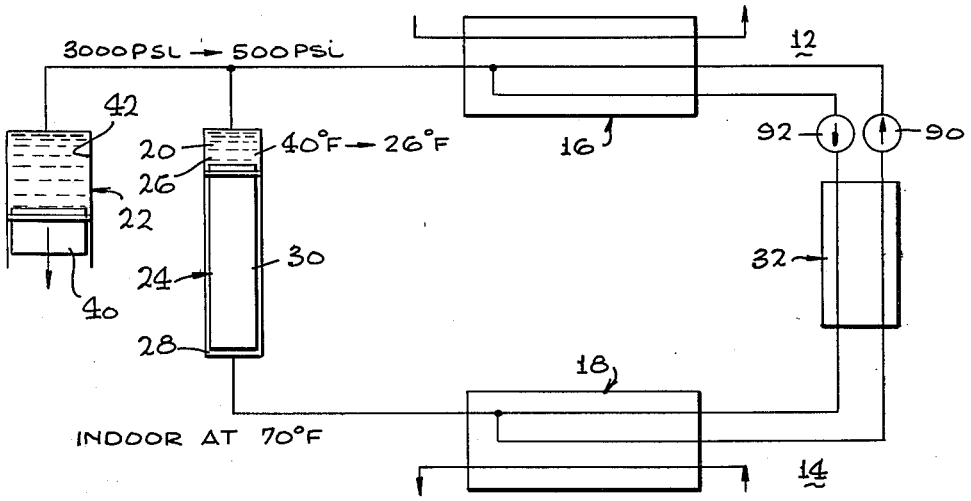
FIGS. 2–5 are schematic diagrams showing different phases in the cycle of operation of the heat pump system of FIG. 1, when utilized to heat an indoor environment by pumping heat from a colder outdoor environment into the indoor environment.
Figure 3:
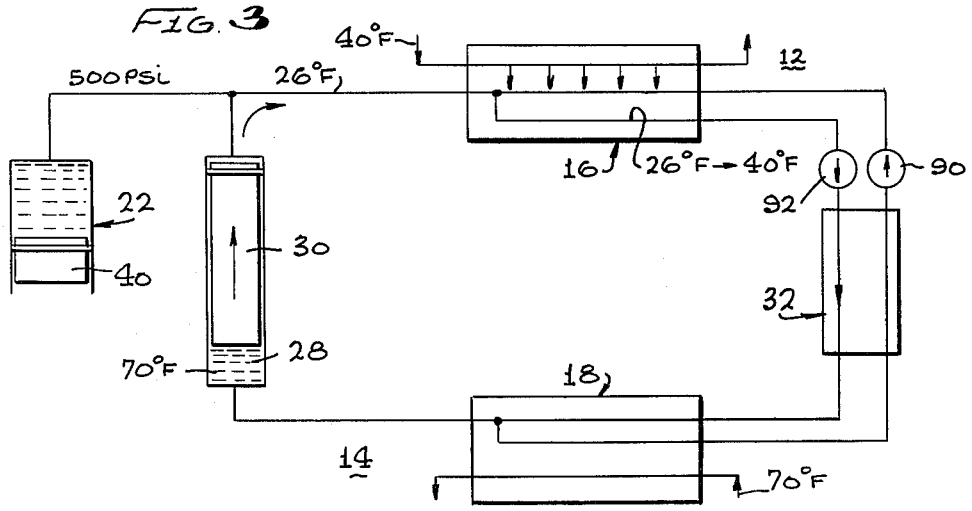

FIGS. 2–5 indicate a cycle of operation of the system 10 when the medium 14 is the air in an indoor environment which must be heated to maintain it at a room temperature such as 70° F., while the other medium 12 may be cool air or water in the outdoor environment at a temperature such as 40° F. from which heat must be pumped to heat the indoor environment. FIG. 2 shows the system in a state wherein the displacer 24 has been operated so its upper reservoir 26 is filled and its lower reservoir 28 is empty. The compressor 22 is then operated to lower the pressure of the working fluid 20, as by moving down the compressor piston 40 to expand the volume in a cylinder 42. If it is assumed that the fluid 20 in the reservoir 26 was initially at 40° F. (the temperature of the outdoor environment), then the expansion may typically reduce the temperature to 26° F. FIG. 3 shows that the low pressure fluid is then displaced by the displacer piston 30 to move it through the heat exchanger 16. As a result, heat is exchanged or pumped from the 40° F. outdoor medium to the expanded working fluid to heat it from 26° F. to 40° F. This 40° F. expanded fluid flows through the regenerator 32 where it is gradually heated to 70° F., which is the temperature of the indoor environment. The 70° F. expanded fluid moves into the lower displacer reservoir 28.

Figure 4:
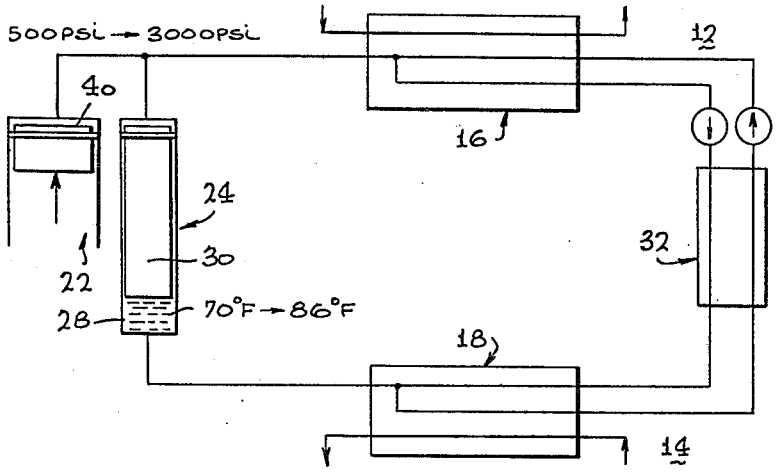
Figure 5:
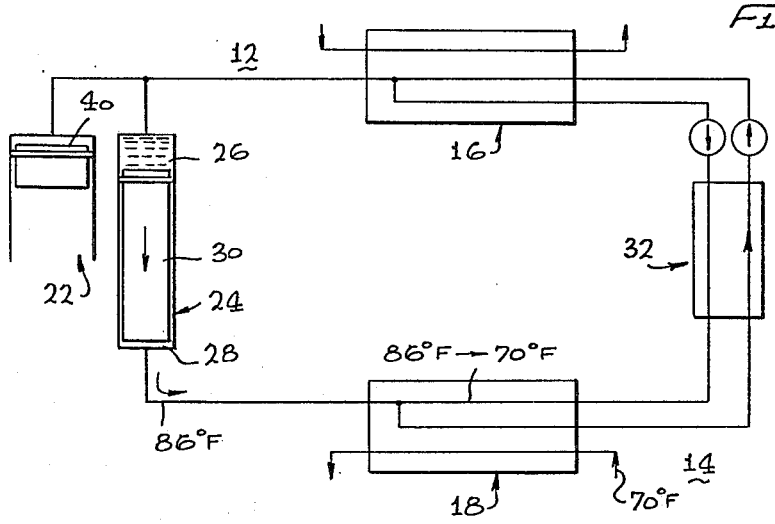

FIG. 4 shows that with the expanded working fluid at 70° F. in the lower reservoir 28, the compressor 22 is operated to compress the working fluid to a high pressure. This causes the fluid in the lower reservoir 28 to rise in temperature as from 70° F. as 86° F. FIG. 5 shows that the displacer piston 30 is then operated to move the compressed fluid at 86° F. out of the lower reservoir 28 and through the heat exchanger 18, where heat is pumped from the 86° F. fluid to the 70° F. medium 14 of the indoor environment. In this way, air in the environment is heated to help maintain it at 70° F.

In transferring heat out of the initially 86° F. compressed fluid, as indicated in FIG. 5, the temperature of the fluid is decreased, as to nearly 70° F., and this compressed fluid at 70° F. flows through the regenerator 32 to the upper displacer reservoir 26. (It may be noted that flow from the regenerator 32 to a reservoir 26 or 28 does not have to be by way of a heat exchanger, although it is helpful to transfer some heat). During flow of the compressed fluid out of the heat exchanger 18 and through the regenerator 32, heat is gradually transferred from the fluid to other working fluid which will be travelling (in the next half cycle) in the opposite direction, so that the compressed fluid emerges from the upper end of the regenerator 32 at a lower temperature such as 40° F., and this fluid at 40° F. enters the upper reservoir 26. The next step is as shown in FIG. 2, wherein the fluid in the upper reservoir 26 is expanded again.

The same system can be utilized to cool an indoor environment to perhaps 70° F. when the outdoor environment is at a higher temperature such as 100° F. In this case, the working fluid is moved under low pressure (and perhaps at 100° F.) into the upper reservoir 26, compressed to raise its temperature (to perhaps 118° F.) and passed through the upper heat exchanger 16 to lower its temperature (to perhaps 100° F.). Fluid at high pressure and moderate temperature (e.g. 70° F.) is simultaneously moved into the lower reservoir 28, then expanded to lower its temperature (e.g. to 55° F.) and passed through the lower heat exchanger 18 to cool the indoor environment.

The working fluid 20 which is circulated between the displacer reservoirs 26, 28 through the heat exchangers and regenerator, is a liquid which remains in the liquid phase throughout the cycle of operation. A liquid has the advantage over a gas of having a high heat transference capability when a small volume of it is moving in a narrow passage, and without large frictional losses. This is a direct consequence of the adequate thermal conductivity and the high specific heat per unit volume of a liquid. The low compressibility of liquids, especially compared to gases, allows substantial pressure changes to be utilized without the hazard of mechanical explosion. Also, the nearly constant density of working fluid allows the machine to be symmetrical so that the same size heat exchangers can be used at the heat source and the heat sink. Not all liquids are equally useful in the present heat transfer device. For example, water near room temperature has a very low compressibility so that only very small volume changes result in a pressure change such as 2000–3000 psi. If water at room temperature is compressed to about 3000 psi adiabatically (with no heat transferred to or from it) then it will increase in temperature by about 0.6° F., which is so small that it could not be used to pump over any significant temperature range. A greater increase in temperature can be obtained if very high pressures of perhaps ten times as much (such as 30,000 psi) are applied, but equipment of moderate cost and high reliability is not easily obtained which can produce and operate with such high pressures. Pressures on the order of 3000 psi are commonly encountered in hydraulic systems and can be applied and contained with considerable reliability with equipment of moderate cost. It may be noted that much lower pressures such as 100 psi can be utilized in heat pumps using the Rankin cycle where both liquid and vapor are present, but such relatively low pressures may require more bulky equipment than higher pressures such as about 3000 psi.

Another possible disadvantage which can arise in the use of liquid working fluids, is that the temperature coefficient of expansion of liquids changes with their temperature. The theoretical maximum efficiency of a liquid-based heat pump decreases as the temperature difference between the heat source and heat sink increases, owing to the change of thermal expansion coefficient. However, while the decrease in efficiency is significant where very large temperature differences are encountered (such as between 70° F. and 625° F. for a heat engine utilizing liquid as proposed by Malone, as discussed earlier herein), there is only a small decrease in efficiency where there are small temperature differences such as between 40° F. and 70° F.

High efficiency of operation of the heat pump of the present invention which utilizes a liquid working fluid, is obtained by utilizing a working fluid having a large temperature coefficient of expansion which is preferably at least $1\times10^{-3}$/°K. at room temperature such as 70° F. and moderate liquid working pressure such as 1750 psi (which is the average pressure of a system which operates between about 500 and 3000 psi). Propylene has a temperature coefficient of expansion of $2.6\times10^{-1}$/°K. at 28° C. and 1750 psi. This may be compared to water which has a temperature coefficient of expansion of about $2.4\times10^{-4}$/°K. at the same temperature and pressure, which is about one-tenth that of propylene. It may be noted that the temperature coefficient of expansion is the change in volume per unit volume of the liquid, and per unit change in temperature (as in degrees Kelvin). The amount of heat transferred in each cycle of operation can be given by the formula:

$$Q=T\times\beta\times V_d x\Delta p,$$

where Q is the amount of heat transferred, T is the absolute temperature at which the heat is transferred, $\beta$ is the pressure averaged coefficient of expansion of the working fluid, $V_d$ is the displaced volume of working fluid (amount moved by the displacer 24, so that volume 26 or 28 is at maximum), and $\Delta p$ is the change in pressure of the working fluid (produced by the compressor 22).

As mentioned above, the temperature coefficient of expansion of liquids changes, so that the coefficient of propylene increases to $3.0\times10^{-3}$/°K. at 48° C. and 1750 psi, and decreases to $2.2\times10^{-3}$/°K. at 0° C. and 1750 psi. However, over the range of temperatures encountered in heating or cooling an indoor environment by use of a heat pump, these changes in temperature coefficient of expansion are relatively small and do not seriously decrease the efficiency of the system. Propylene also may be compared to water in terms of their coefficients of compressibility. Propylene at 2000 psi and 23° C. has a coefficient of compressibility of $2.6\times10^{-5}$/psi (i.e. a quantity of propylene decreases in volume by about 0.003% for an increase in pressure of one psi, or in other words decreases by almost 8% for an increase in pressure of 3000 psi). Water has a coefficient of compressibility at 21° C. and any pressure up to at least a few thousand psi of $2.5\times10^{-6}$/psi which is less than one-tenth that of propylene. In addition to propylene, suitable working liquids for the system of the present invention are Freon 114, Freon 13B1 and isobutane. Of all of these, propylene appears to be the best liquid working fluid for heat pump designs that have been made. It may be noted that at 70° F. propylene must be maintained at a pressure of a few hundred psi to avoid vaporizing, and any liquid used should be maintained at a pressure above its saturation vapor pressure.

FIGS. 6–11 illustrate details of several elements of the system of FIG. 1. FIG. 6 illustrates details of the displacer 24 which moves the liquid working fluid through the conduits of the system without changing the pressure of the fluid. The displacer 24 includes a displacer cylinder 50 and a displacer piston 30 which moves in the cylinder to control the volumes of the reservoirs 26, 28 formed at the opposite ends of the cylinder. The piston 30 is sealed to the inside of the cylinder by an O-ring 52 located near one end of the piston. The other end of the piston has several guide button members 54 for slidably guiding it. Fluid couplings 56, 58 are provided at the opposite ends of the cylinder to pass the fluid into and out of the reservoirs. A piston rod 60 reciprocates the piston 30, with only a small amount of power required to move the piston. In a preferred drive geometry, the displacer piston 30 is reciprocated without change in the volume of working fluid in the system.

In a system that has been constructed using the displacer 24, the cylinder 50 had an inside diameter of two inches and a length of two feet, and the piston was moved a distance of two inches between its extreme positions. Friction was minimized by constructing the piston 30 to leave a clearance space of about 10 mil (thousandths of an inch) between it and the cylinder walls. One problem that can arise is that there is a possibility of heat transference between the opposite reservoirs 26 and 28 due to reciprocation of the piston. For example, when the piston moves down, the bottom of it is in thermal contact with the cylinder wall at perhaps 86° F. When the piston moves up by two inches it may heat the cylinder wall at a slightly higher elevation to nearly 86° F. When the piston moves down again, the cylinder wall which was heated to about 86° F. could heat the higher portion of the piston that it contacts, and so forth, so that heat would be transferred up along the displacer with every reciprocation (this is referred to as shuttle heat transfer). To avoid this, the piston 30 is constructed with a thermally insulative layer 58 on its outside, around the metal core 60, to minimize heat transfer between the cylinder wall and the reciprocating piston.

Figure 8:
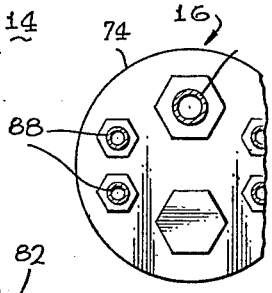
FIG. 8 is a view taken on the line 8—8 of FIG. 7.
Figure 7:
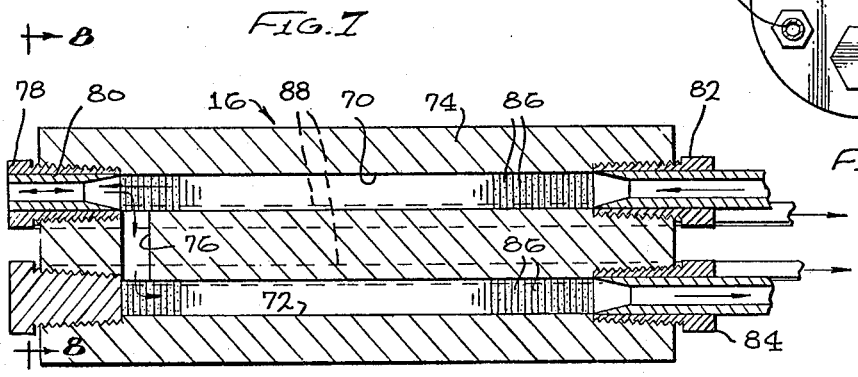
FIG. 7 is a partially sectional view of one of the heat exchangers of the system of FIG. 1.

The heat exchanger 16 shown in FIGS. 7 and 8, includes a pair of heat exchanger passages 70, 72 formed in a metal (e.g. copper) frame 74, and with a connecting passage 76 provided to connect the two passages at the end closer to the displacer. Of course, the interconnection passage 76 can be placed beyond the end of frame 74 but the interconnection passage can still be considered part of the exchanger. A fluid coupling 78 at one end of the passages is connected to a pipe 80 that extends to one end of the displacer. A pair of fluid couplings 82, 84 at the other end of the frame connect to two different passages of the regenerator. Stacks of copper screens 86 lie along each of the passages 70, 72 to provide a good thermal coupling between the frame 74 and the working fluid in the passages. The frame 74 also includes several tubes 88 which carry the medium 12 with which heat is exchanged with the outside environment. For example, where the device is used to heat a home, where the outside temperature is very low but a water source such as ground water or lake water is available at 40° F., the medium 12 may be such water. In another situation, the medium 12 may be air in the outdoor environment or there may be a water to air heat exchanger.

FIGS. 9–11 illustrate details of the regenerator 32 which is utilized to gradually heat working fluid moving in one direction from one heat exchanger to the other, and to gradually cool fluid moving in the opposite direction. Such one way movement of working fluid in opposite directions is caused by the use of a pair of one-way or check valves 90, 92 which are formed in series with a pair of annular passages 94, 96 in the regenerator. As shown in FIG. 10, the regenerator includes a frame having an outer cylinder 100 and a central core 102, and having a long stack 104 of screen members 106 lying in the annular space between the cylinder and core. Each of the screen members 106 is formed of a sheet of fine copper screen material cut out in an annular shape to closely fit the annular space in the frame. In addition, each screen member has a separator ring 108 lying between its inner and outer edges, which serves to prevent fluid from flowing between the inner region **106*i* and outer region 106*o*** of the screen member.

As shown in FIG. 11, the separator region 108 of each screen member is formed of a material such as solder and projects slightly beyond opposite faces of the screen member. The stack of screen members are assembled so that the separator regions 108 press against one another to form a barrier that prevents mixing of working fluid in the two passages 94, 96. The copper screens make good thermal contact with the liquid flowing past them, and this heat is effectively transfered laterally between the inner and outer screen portions **106*i* and 106*o***, to effect good heat transfer between liquids in the two passages.

The flowing of liquid in opposite directions through two separated passages 94, 96 in the regenerator permits the system to operate effectively even though only a small portion of the total working fluid in the system is moved from one reservoir to the other at each cycle. In the example given above, wherein one heat exchanger 16 (FIG. 9) pumps heat from a 40° F. outdoor environment and the other 18 pumps heat into a 70° F. environment, fluid entering the bottom of passage 94 will be at 70° F. As fluid moves up along the passage 94, it constantly transfers heat laterally to the copper screen 106 and to fluid in the other passage 96, so that the temperature of the fluid in passage 94 gradually decreases at locations progressively closer to the upper end of the regenerator, and fluid emerging from the upper end of the passage 94 is at substantially 40° F. Of course, fluid flowing downwardly along the other passage 96 gradually increases in temperature from 40° F. to 70° F. Such heat transfer is effective even though only a small portion of the working fluid, such as perhaps 10% of it, flows out of each reservoir during each cycle of operation of the system.

In tests made on a regenerator stack of the type shown in the figures, which utilizes a stack of screen members, it was found that the effective lateral screen conductivity (in the direction indicated by arrow 110 in FIG. 11), was a quarter the thermal conductivity of bulk copper while the effective thermal conductivity in the longitudinal direction indicated by arrow 112 was a tenth that of bulk copper. The screen members 106 were formed of woven copper threads of 4.3 mil diameter with a 10 mil pitch and with each member having an outside diameter of 1⅝ inches and an inside diameter of 1.0 inches. The separator regions 108 were formed of 20 mil wide solder, at a location to provide equal cross sectional flow areas at the inner and outer regions **106*i* and 106*o*. The screen members were assembled in a regenerator having a length of 28.5 inches, with the screen members stacked along lines parallel to the lengths of the passages 94, 96. The combination of the intimate association of the copper with liquid working fluid, and the effective lateral conduction of heat through the copper and also through the liquid working fluid, enables effective lateral heat transfer to provide only a small temperature difference between working fluid at all locations along, or laterally spaced from, the center line 114** of flow of the regenerator.

The compression and expansion of the liquid working fluid can be accomplished in a number of ways, as by the use of a reciprocating (or even rotating) piston. However, with a reciprocating piston that alternately compresses the fluid as the piston moves in one direction and expands it as the piston moves in the other direction, pressure is gradually increased and decreased as in a harmonic manner. The system of FIG. 1 can be operated by reciprocating the displacer piston 30 in synchronism with the compressor piston 40 but with the two pistons 30, 40 being 90° out of phase. In pumping heat from a cool environment at 12 to a room temperature environment at 14, the pistons are operated so that the compressor piston 40 lags the displacer piston 30 by 90°, to achieve maximum compression (piston 40 at topmost position) when the displacer piston 30 is moving down to increase the size of the upper reservoir 26, and to cause the piston 40 to reach its lowest position for maximum expansion as the displacer piston 30 is moving up to move the expanded fluid out of the upper reservoir. This can be accomplished by coupling both pistons to a rotating crank shaft, but at locations chosen to operate them 90° out of phase. The same system can be utilized to pump heat in the opposite direction, as to cool a room when the outdoor environment is hot, by rotating the crank member in reverse so the compressor piston leads the displacer piston by 90°.

While considerable work is required to compress the working fluid, it is noted that most of the work can be recovered by utilizing the expanding working fluid to move the piston. If a single piston is utilized in the system then the power obtained from the expanding working fluid could be stored in a flywheel. However, the amount of energy which can be stored in a flywheel decreases as the speed of the flywheel decreases. The heat pump of the type described above may be cycled at a low rate, such as one cycle per second, to provide time for heat transfer to and from the working fluid at small temperature differences. Of course, a gear train can be utilized to rotate a flywheel at high speed, but the gear train adds to mechanical losses and can considerably increase the cost of the system.

Figure 12:
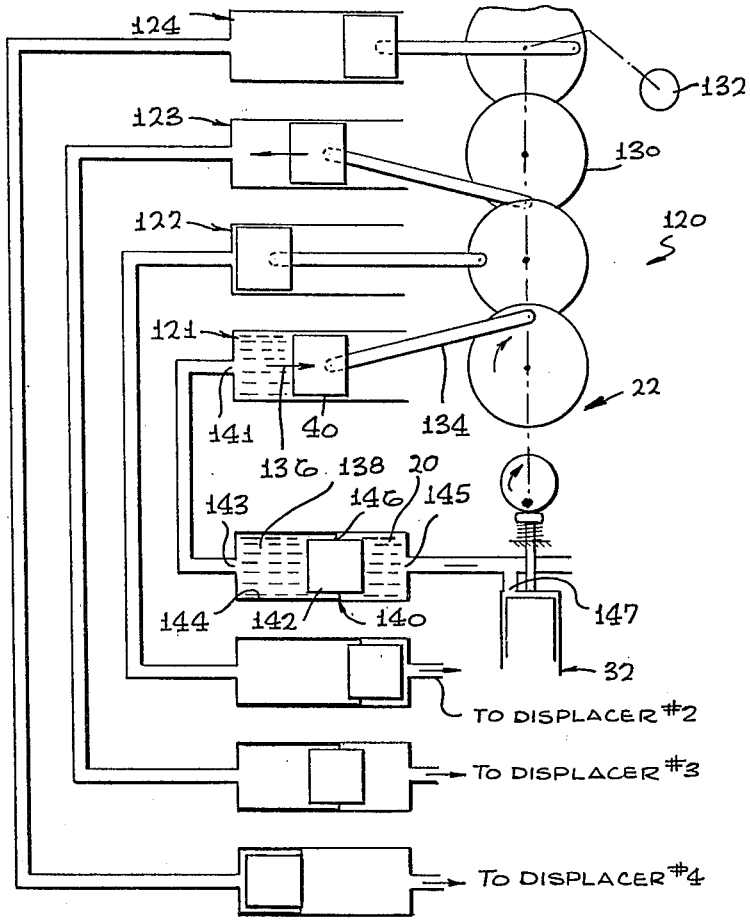
FIG. 12 is a schematic diagram of a pump system constructed in accordance with another embodiment of the invention.

FIG. 12 illustrates a heat pump system 120 which utilizes four separate heat pump units 121–124 that operate 90° out of phase with one another. This enables the power obtained during expansion of working fluid in one unit, to help move one or more pistons in other units that are compressing their working fluids. The system 120 includes a crank member 130 (indicated by four circles) that is rotated by a motor 132, and which is connected by connecting rods 134 to the compressor pistons 40 of the compressors of different heat pump units. The connecting rods are connected to the crank member 130 so that the compressors of the units 121-124 operate successively 90° out of phase with one another. The crank member 130 can be of the crankshaft type utilized in multiple cylinder automobile engines or the like. As each piston 40 is moving rearwardly in its cylinder or chamber, as in the direction 136 to expand the working fluid in the unit, the force on the piston allows it to help turn the crank member 130 so as to provide power for moving another piston which is simultaneously compressing the working fluid in its unit. Of course, a variety of coupling mechanisms can be included, such as cam followers on a rotating cam member. Under ideal conditions the torque required from the motor 132 is just proportional to the temperature difference spanning the heat transfer machine.

Although it is possible to use a piston or the like to directly compress working fluid in the system, more efficient operation can be obtained by utilizing a separate hydraulic fluid 138 (FIG. 12) in the compressor 121. In addition, a separator means 140 is provided which prevents mixing of the hydraulic fluid 138 with the working fluid 20 in the heat pump unit, while transmitting pressures between them. The separator means 140 is shown as including a piston 142 moving in a separator cylinder 144, with the piston having opposite ends respectively facing the hydraulic fluid 138 and the working fluid 20 to transmit pressures between them. Ports 141 and 143 of the compressor and separator are connected by a conduit, while ports 145 and 147 of the separator and displacer 32 are connected by another conduit. A rolling diaphragm seal 146 is utilized to prevent mixing of the hydraulic and working fluids. Of course, a variety of separator means can be utilized, including those which can increase or decrease the pressure transmitted to the working fluid but with a corresponding change in ratios of volumetric displacements.

The use of a separate hydraulic fluid 138 enables a fluid to be utilized which undergoes very little change in volume and temperature when compressed to pressures on the order of 3,000 psi. For example, a hydraulic fluid having a temperature coefficient of expansion of about $2\times10^{-4}$/°K. and a coefficient of compressibility of $2\times10^{-6}$/ psi is suitable. This helps avoid energy losses caused by heat transfer from the hydraulic fluid at locations (e.g. at the compressor 22) where such heat transfer is not productive. The reduction in the amount of relatively compressible fluid also reduces the required stroke of the compressor piston. In addition, a hydraulic fluid can be chosen which provides good lubrication for the pistons, is of relatively low cost, is safe, etc.

An important application of the heat transfer device is in a situation where a varying high pressure is already available, as for example with a liquid working fluid thermocompressor or with a Malone prime mover. By using a fluid separator (for example piston 140 in FIG. 12) so that an appropriate liquid can be used in the heat transfer device, the pressure variations perform the function of the piston and cylinder of a compressor while the displacer is moved in proper phase with respect to these pressure variations to achieve the desired effect such as cooling. A large scale application of this embodiment of the invention would be to a refrigerated cargo ship propelled by a prime mover that generates low frequency pressure pulses.

Figure 13:
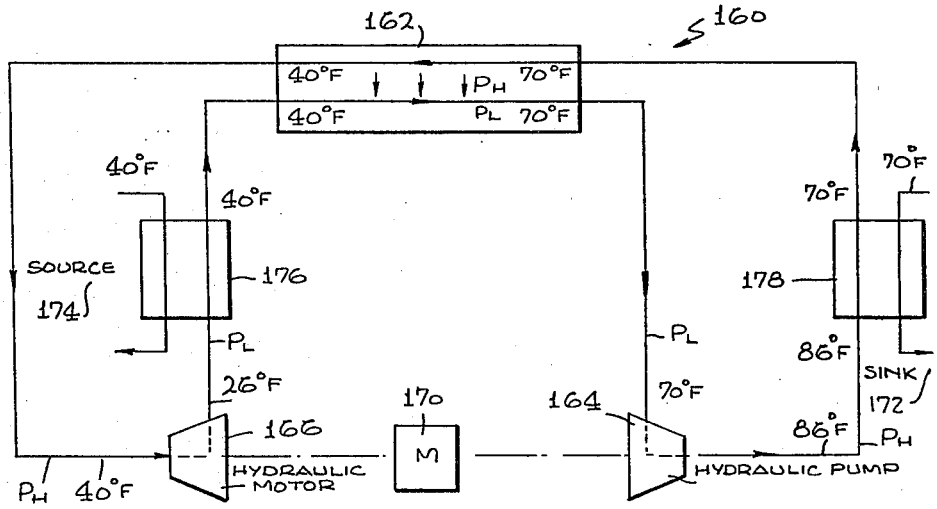
FIG. 13 is a schematic diagram of a pump system constructed in accordance with still another embodiment of the invention.

Another embodiment of a heat transfer device using liquid working fluid and which can pump heat or refrigerate is shown in FIG. 13. The device 160 utilizes a countercurrent heat exchanger or regenerator 162, but does not use a displacer. The device 160 employs a hydraulic pump 164 to adiabatically raise the pressure of the liquid working fluid such as propylene, from a low pressure $P_L$ such as 500 psi to a high pressure $P_H$ such as 3000 psi. It also employs a hydraulic motor 166 to reduce the pressure adiabatically from $P_H$ to $P_L$. It may be noted that in the heat transfer devices of FIGS. 1-12, the pressure of the liquid working fluid is instantaneously the same throughout the machine at any instant, and changes only with time, with the pressure difference across the internal walls of the regenerator being essentially zero. However, in the heat transfer device of FIG. 13, the pressure at a given point in the machine is essentially constant and the full pressure difference $P_H-P_L$ stresses the internal walls of the counter current heat exchanger 162. The operation of the heat transfer device is indicated in FIG. 13 by an example wherein an indoor room serves as the heat sink 172 to be heated to 70° F., while an outdoor water source 174 at 40° F. serves as the heat source. A pair of heat exchangers 176, 178 exchange heat with the liquid working fluid and the external environments.

Flow of the liquid working fluid in the heat transfer device of FIG. 13 can be either pulsating unidirectional or continuous, depending on the qualities of the hydraulic pump and motor. This embodiment of the invention, which is thermodynamically similar to the Brayton cycle used in some gas turbines, uses the hydraulic motor 166 plus an additional externally powered (e.g. by electricity) motor 170 to drive the hydraulic pump 164, to thereby reduce the external power needed to drive the heat transfer device. While the device of FIG. 13 is thermodynamically simpler than those of FIGS. 1-12, it can give rise to seal problems and the design of the hydraulic pump 164 and motor 166 can be more complicated.

The use of a working fluid in the present heat transfer devices has many advantages over prior art gas or combined liquid-gas cycles. Liquids have a higher heat capacity per unit volume than gas, so that the heat exchangers and other fluid-carrying elements can be made more compact for a system of given capacity. The ability to use high pressures such as thousands of psi without the large explosion hazard inherent in systems using compressed gas, enables further compaction in the device and in pumps utilized to supply the required pressures. Liquids also can provide the smoothness of operation which is characteristic of hydraulic systems. The single phase (liquid) of the working fluid also facilitates reversibility of the system to enable operation as a heat pump or as a refrigerator (air conditioner), because each heat exchanger carries only a liquid working fluid in either mode of operation. The low friction losses, high thermal conductivity of the working fluid, and small change in temperature coefficient of expansion of the fluid as the temperature difference between source and sink decreases, enables the device to be utilized efficiently even as the temperature differences between source and sink approaches zero. It may be noted that full advantage of potential heat exchanger compactness normally requires that a liquid medium be available at the heat source and/or heat sink for exchanging heat with the liquid working fluid. In the case of an outdoor source, this medium may be ground water, sea or lake water, power plant or industrial effluent, solar heated water, or water in an air-to-water heat exchanger.

Thus, the invention provides a heat pump apparatus which is compact and of high efficiency particularly when pumping heat between a source and sink which are not widely separated in temperature, as for example in pumping heat from ground water (source) to a dwelling (sink). The source and sink can be interchanged functionally simply by reversing the sense of rotation of the machine, the apparatus having excellent thermodynamic qualities even as the temperature difference between source and sink becomes small or changes sign. The apparatus includes a liquid working fluid which has a high temperature coefficient of expansion, preferably more than $1\times10^{31\ 3}$ per °K. at room temperatures, to produce appreciable changes in temperature of over 1° F. and preferably over 1° C. when compressed or expanded to pressures such as a few thousand psi. The system can include a displacer which forms a pair of reservoirs or other means for moving fluid from one reservoir to the other through at least one heat exchanger by way of a regenerator. The regenerator can include passages which permit fluid flow in only one direction, to permit effective operation of the system with movement of only a small portion of the total working fluid in each cycle of operation. The regenerator can be formed of a stack of screen members which are separated to form a pair of adjacent channels. Such screen members effectively transfer heat to or from the working fluid, and between fluid lying in the different passages, to create large lateral heat transfer so as to transfer heat between portions of the working fluid which are at only slightly different temperatures. The apparatus for compressing the liquid working fluid can also utilize a hydraulic fluid which is compressed, and a separator which transfers pressures between the relatively incompressible hydraulic fluid and the more compressible working fluid. Utilization of energy available during expansion of the working fluid can be achieved in a slowly operating system, by the use of a group of heat pump units which are coupled together so that the power which can be supplied by the expanding working fluid of one unit is utilized to compress the working fluid in another unit.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a heat transfer apparatus which includes a pair of heat exchangers, a regenerator having opposite ends coupled to the different heat exchangers and employing at least two flow channels in which the fluid flows oppositely and means for compressing and expanding the working fluid the improvement wherein:

said working fluid is a liquid which is comressible and expandable by said compressing means sufficiently to produce an adiabatic temperature change of more than one °F. while constantly remaining in a liquid phase.

2. The apparatus described in claim 1 wherein:

said liquid when initially at 70° F. undergoes an adiabatic temperature increase of a plurality of °F. when subjected to an increase in pressure of 2500 psi.

3. The apparatus described in claim 1 wherein:

said liquid has a temperature coefficient expansion of at least $1\times10^{-3}$ per °K. at 70° F.

4. The apparatus described in claim 1 wherein:

said regenerator comprises a stack of thermally conductive screen members, with the stacking direction primarily parallel to said passages and with laterally spaced portions of said stack sealed from one another against the flow of liquid but in thermal connection through the screen members.

5. The apparatus described in claim 1 including:

a pair of coupled reservoirs coupled to the different heat exchangers;

means for displacing the liquid working fluid at constant volume to flow out of one reservoir and through a heat exchanger and the regenerator to the other reservoir; and means for alternately compressing and expanding the working fluid in controlled phase relationship with the means for displacing fluid.

6. The apparatus described in claim 1 wherein said apparatus includes a plurality of pump units, each unit having a regenerator, a pair of reservoirs, displacer means, a quantity of working fluid, and a compressing means, each compressing means including a cylinder, a piston movable in said cylinder, and fluid in said cylinder; and a motor and a crank member driven by said motor and coupled to the pistons of said plurality of pump units, to oscillate them to pump out and receive fluid at different times, so that the movement of a first piston during expansion of the fluid in the corresponding displacer allows the power applied by the expanding working fluid to help turn the crank member to move another piston which is moving in a direction to compress working fluid in its corresponding displacer.

7. The apparatus described in claim 1 wherein:

said compressing means includes a chamber, a piston moveable in said chamber, a hydraulic fluid in said chamber, and separator means having first and second ports respectively coupled to the hydraulic fluid in said chamber and to said liquid working fluid and also having means which transmits pressures between fluids in said first and second ports while preventing mixing of the fluids.

8. A heat pump or refrigerator apparatus comprising:

first and second heat exchangers, each having a pair of working fluid-carrying passages interconnected at a first end of the exchanger and unconnected at the other end of the exchanger to form a pair of ports;

a regenerator forming primarily parallel first and second passages which are physically separated but closely thermally coupled at numerous locations along the passages, said regenerator having check valve means allowing flow only in one direction through the other passage, said passages each having first ends coupled respectively to the pair of ports of said first heat exchanger and said passages having second ends that are coupled respectively to the pair of ports of said second heat exchanger;

a displacer having a first end connected to the first end of said first heat exchanger, said displacer having a second end connected to the first end of said second heat exchanger, said displacer also having a reservoir at each of its ends and having means for moving fluid at constant volume out of the reservoir at one end while receiving fluid at the reservoir at the other end;

a quantity of working fluid lying in said heat exchangers, regenerator and displacer, said fluid being a liquid; and compressor means for alternately compressing and expanding said liquid working fluid.

9. The apparatus described in claim 8 including:

means for cyclically operating said compressor means and displacer to heat an environment coupled to said second heat exchanger, said operating means operating said displacer to move liquid working fluid under high pressure to the reservoir at said first end of said displacer, for reducing the pressure of the fluid when most of the fluid moved is in said first end reservoir of said displacer, for operating said displacer to move fluid at reduced pressure out of said first end reservoir of said displacer through said first heat exchanger to said regenerator to flow fluid into the reservoir at said second end of said displacer, for increasing the pressure of the fluid when most of the moved fluid is in said second end reservoir of said displacer, and for operating said displacer to move fluid under high pressure out of said second end reservoir through said second heat exchanger to said regenerator.

10. The apparatus described in claim 8 including:

means for cyclically operating said compressor means and displacer to cool an environment coupled to said second heat exchanger, said operating means operating said displacer to move liquid working fluid under low pressure to the reservoir at said first end of said displacer, for increasing the pressure of the fluid when most of the fluid moved is in said first end reservoir of said displacer, for operating said displacer to move fluid at high pressure out of said first end reservoir of said displacer through said first heat exchanger to said regenerator to flow fluid into the reservoir at said second end of said displacer, for reducing the pressure of the fluid when most of the moved fluid is in said second end reservoir of said displacer, and for operating said displacer to move fluid under low pressure out of said second end reservoir through said second heat exchanger to said regenerator.

11. The apparatus described in claim 8 wherein:

said liquid working fluid is of a type which undergoes a temperature change of over one °F. when initially at 70° F. and saturation vapor pressure and then adiabatically compressed incrementally by over 1000 psi, and said compressing means applies an additional pressure at maximum pressure which is more than 1000 psi above minimum pressure.

12. The apparatus described in claim 8 wherein:

said liquid working fluid is chosen from the group which consists of propylene, Freon 114, Freon 13Bl, and isobutane.

13. The apparatus described in claim 8 wherein:

said regenerator comprises a stack of thermally conductive screen members, with the stacking direction primarily parallel to said passages and with laterally spaced portions of said stack sealed from one another against the flow of liquid but in thermal connection through the screen members.

14. The apparatus described in claim 8 wherein:

said displacer includes a cylinder, a displacer piston slideable in said cylinder and having first and second opposite end portions, a seal ring mounted on said first end portion of said piston to seal said piston end portion to the cylinder, and a plurality of guide members mounted on the second end portion of the piston to guide it in sliding movement in the cylinder;

said piston being of smaller outside diameter than the inside of said cylinder in a region extending between said seal and guide members to prevent piston-to-cylinder contact between them along said region, and said piston having a metal core and having a layer of thermally insulative material around said core along said region.

15. The apparatus described in claim 8 wherein:

said compressing means includes walls forming a compressor chamber which holds a second fluid, a compressor piston moveable in said chamber, and separator means coupled to said compressor chamber to receive said second fluid and to said reservoirs to receive said working fluid for transmitting pressures between said fluids while keeping them separate;

said working fluid having a temperature coefficient expansion of at least $1\times10^{-3}$ per °K., and said second fluid having a temperature coefficient of expansion of less than one-fifth as much.

16. A method for pumping heat from a heat source into a heat sink comprising:

flowing working fluid primarily under high pressure into a first end of a displacer, while also flowing said fluid in a first direction through a first passage of a regenerator;

reducing the pressure of said fluid to lower its temperature;

flowing said fluid while primarily under low pressure from said first end of said regenerator through a first heat exchanger which is coupled to the heat source to increase the temperature of the fluid, while also flowing said fluid in a second direction through a second passage of the regenerator and exchanging heat with fluid in the first passage by heat conduction largely in a direction perpendicular to the lengths of said passages, and while also flowing said fluid in a second direction through a second passage of the regenerator and exchanging heat with fluid in the first passage by heat conduction largely in a direction perpendicular to the lengths of said passages, and while also flowing said fluid into a second end of said displacer;

increasing the pressure of said fluid to increase its temperature;

flowing said fluid primarily while under high pressure from said second end of said regenerator through a second heat exchanger which is coupled to the that sink to decrease the temperature of the fluid;

said fluid flowing in a liquid phase through said heat exchanger, regenerator passages, and the ends of said displacer, and said step of increasing the pressure including applying a maximum pressure of at least about 1000 psi above saturated pressure to said liquid fluid.

17. A method of air conditioning an indoor environment to keep it at a temperature of about 70° F. by pumping heat into a higher temperature heat sink which is in a range (such as on the order of 100° F. but extending downward to the desired indoor temperature) which is normally encountered outdoors, comprising:

circulating a fluid back and forth between a sink displacer reservoir and a source displacer reservoir, by way of a sink heat exchanger which is thermally coupled to said higher temperature heat sink, alternate one-way passages of a regenerator, and a source heat exchanger which is thermally coupled to said indoor environment;

pressurizing said fluid primarily after flowing it into said sink reservoir, to raise the temperature of fluid in the sink reservoir above that of the heat sink, and relieving said pressure primarily after flowing said fluid into said source reservoir to lower the temperature of fluid in the source reservoir, said step of circulating including flowing the pressurized fluid in the sink reservoir through the sink heat exchanger and flowing the pressure-relieved fluid in the source reservoir through the source heat exchanger;

said step of circulating a fluid by way of alternate one-way passages of a regenerator, including flowing heat along primarily parallel passages and exchanging heat between fluids at adjacent locations along the two passages; and said step of circulating a fluid including circulating a liquid in solely a liquid phase between said reservoirs, wherein said liquid is of type which has a temperature coefficient of expansion of at least $1\times10^{-3}$ per °K. at 70° F. and 1000 psi, and said step of pressurizing including applying a maximum incremental pressure of at least about 1000 psi.

18. A method for heating an indoor environmemt heat sink to keep it at a temperature of about 70° F. by pumping heat from a lower temperature heat source which is in a range (e.g. on the order of 40° F. but extending upward to the desired indoor temperature) that may be encountered outdoors, comprising:

circulating a fluid back and forth between a sink displacer reservoir and a source displacer reservoir, by way of a sink heat exchanger which is thermally coupled to said indoor environment, alternate one-way passages of a regenerator and a source heat exchanger which is thermally coupled to said lower temperature heat source;

pressurizing said fluid primarily after flowing it into said sink reservoir to raise the temperature of fluid in the sink reservoir above that of the heat sink, and relieving said pressure primarily after flowing said fluid into said source reservoir to lower the temperature of fluid in the source reservoir below that of the heat source, said step of circulating including flowing the pressurized fluid in the sink reservoir through the sink heat exchanger and flowing the pressure-relieved fluid in the source reservoir through the source heat exchanger;

said step of circulating a fluid by way of alternate one-way passages of a regenerator, including flowing heat along primarily parallel passages and exhanging heat between fluids at adjacent locations along the two passages; and said step of circulating a fluid including circulating a liquid in solely a liquid phase between said reservoirs wherein said liquid is of a type which has a temperature coefficient of expansion of at least $1\times10^{-3}$ per °K. at 70° F. and 1000 psi, and said step of pressurizing including applying a maximum pressure increment of at least about 1000 psi.

19. A heat pump apparatus comprising:

a plurality of heat pump units, each having a pair of displacer reservoirs;

means for flowing a working fluid from a first reservoir through a first heat exchanger and into the second reservoir and then flowing fluid from the second reservoir through the second heat exchanger to the first reservoir, and means for compressing all of the working fluid after flowing some fluid into said first reservoir but before flowing most of the fluid therein through said first heat exchanger, and for relieving the pressure on all of the working fluid after flowing fluid into said second reservoir but before flowing most of the fluid therein through said second heat exchanger; and wherein the means for compressing and relieving the pressure in each of said pump units, includes a compression cylinder and a compressing piston moveable in said cylinder, and with the cylinder coupled to the working fluid to pressurize and expand it as the piston moves;

a motor-driven crank member; and means for connecting the pistons of said plurality of pump units to said crank member to operate them out of phase with one another so that as one piston is moving in a direction to relieve pressure it supplies work tending to rotate said crank member, and at the same time at least one other piston is being moved by said crank member to compress fluid in its pump unit.

20. The apparatus described in claim 19 wherein:

each of said heat pump units includes a displacer cylinder having opposite end portions forming walls of said reservoirs, and said means for flowing a working fluid includes a displacer piston moveable in said displacer cylinder to pump fluid out of one reservoir and into the other; and each of said pump units includes means for reciprocating the compressing piston and displacer piston substantially 90° out of phase with each other, so that maximum pressure is reached in each cycle when about half of the fluid to be moved out of a first reservoir has been moved out while the displacer piston continues to move fluid out of the first reservoir, and minimum pressure is reached when about half of the fluid to be moved out of the second reservoir has been moved out and the displacer piston continues to move fluid out of the second reservoir.

21. The apparatus described in claim 19 wherein:

said working fluid is an easily compressed liquid; and said compressing means includes a second hydraulic liquid lying in said compression cylinder, and separator means connected to said hydraulic and working fluids to transmit pressures between them while keeping said liquids separate.

22. A heat transfer apparatus comprising:

a hydraulic motor having high and low pressure ends;

a hydraulic pump having high and low pressure ends;

first and second heat exchangers, each having opposite ends;

a regenerator having first and second passages which are thermally coupled;

said hydraulic motor and pump, heat exchangers, and regenerator being interconnected, to permit the flow of a working fluid into the low pressure end of the hydraulic pump, out of the high pressure end of the pump through a first passage of said regenerator to the high pressure end of said hydraulic motor, and from the low pressure end of said hydraulic motor through the second heat exchanger and through the second passage of said regenerator to the low pressure end of said hydraulic pump;

drive motor means coupled to said hydraulic pump to help drive it and coupled to said hydraulic motor to enable the hydraulic motor to help drive the hydraulic pump;

a working fluid which is in a liquid phase in said hydraulic motor and pump, heat exchangers and regenerator.

* * * * *